US009318844B2

(12) United States Patent
Yu

(10) Patent No.: US 9,318,844 B2
(45) Date of Patent: Apr. 19, 2016

(54) SWITCH ASSEMBLY OF CABLE CONNECTOR

(71) Applicant: T-CONN PRECISION CORPORATION, New Taipei (TW)

(72) Inventor: Chien-Yi Yu, Taipei (TW)

(73) Assignee: T-Conn Precision Corporation, Taipei (TW)

( * ) Notice: Subject to any disclaimer, the term of this patent is extended or adjusted under 35 U.S.C. 154(b) by 0 days.

(21) Appl. No.: 14/475,542

(22) Filed: Sep. 2, 2014

(65) Prior Publication Data

US 2016/0006171 A1 Jan. 7, 2016

(51) Int. Cl.
*H01R 4/38* (2006.01)
*H01R 13/622* (2006.01)

(52) U.S. Cl.
CPC ..... *H01R 13/622* (2013.01)

(58) Field of Classification Search
CPC .. H01R 13/622; H01R 13/5219; H01R 27/00; H01R 31/06
USPC ..... 439/320, 218, 314
See application file for complete search history.

(56) References Cited

U.S. PATENT DOCUMENTS 4,440,464 A * 4/1984 Spinner ..... H01R 27/00 439/218
7,727,021 B2 * 6/2010 Haruna ..... H01R 9/037 439/607.41
8,192,218 B2 * 6/2012 Sasaki ..... H01R 13/625 439/320

* cited by examiner

*Primary Examiner* — Phuong Dinh

(57) ABSTRACT

The present invention is a switch assembly of cable connector, which comprises a plug having a plug rubber core, a housing, a plurality of pin terminals, a protruding rib and a wire; a plug holder harnessed on the outer edge of the plug rubber core movably; a switching unit joining with the plug holder movably, which is harnessed on the outer edge of the plug rubber core movably, and provided between the housing and the plug holder; and an elastic element harnessed on two ends of the plug rubber core and caught at the housing and the switching unit. Thereby, rotational switching is possible by using the switching unit in conjunction with the elastic element, such that the plug holder may be bonded to different types of sockets, in order to achieve the effects of close locking, detachment prevention, easy assembly, ease to retreat, convenient replacement and maintenance, facile to operate and applicability to at least two different kinds of sockets as the cable connector and a socket are bonded.

6 Claims, 19 Drawing Sheets

SWITCH ASSEMBLY OF CABLE CONNECTOR

BACKGROUND OF THE INVENTION

1. Field of the Invention

The present invention is related to a switch assembly of cable connector, particularly to a cable connector with a switch assembly used for power lines or signal lines.

2. Descriptions of the Related Art

Conventional cable connector may connect a cable to various devices. As the modern industry advances, many connectors are developed continuously for users to perform quick connection. More and more attention has been put to the protection of cable joints. However, in the process of connecting electrical cables, not only good electrical connection characteristics of connectors are necessary, but also a certain joining stress should exist for connector structure. Furthermore, a variety of external factors result in easy looseness of the connector in long term use, such that electrical cables are separated with each other. Thereby, it causes ineffective electrical connection and results in safety problem. Moreover, as the cable connecting plugs are connected with each other, one kind of plug may only be adapted to a certain kind of socket because of specification constraint for various types of sockets and plugs designed in order to lock cable connecting plugs firmly. It is not compliant with the high efficiency and multifunction purposes in modern industrial development. Moreover, material fatigue and structure wear may occur due to long term use, such that the original close fitting function becomes worse. Thus, it is important to design a high efficiency cable connector joint with multiple functions and capable of ease to operation and facile to maintenance.

In a related prior art disclosed in U.S. Pat. No. 7,727,021B2, "Connector having a plug, a socket, and a tubular shield member with an elastic arm", the connector comprises a plug, which comprises a plug main body, a plurality of pin terminals, a plug holder, a coil spring, a slip-out preventing member, and a socket 60, which comprises a socket main body, a plurality of socket terminals, a socket holder. The plug may be inserted to a socket without caulking trough, and may be bonded with the socket. As the plug of the conventional technology is intended to be bonded with the socket without caulking trough, the outer thread of the plug is utilized to screw with the inner thread of the socket without caulking trough. Further, as the plug is intended to connect the socket, the engagement nail of the slip-out preventing member of the plug holder of the plug is utilized to enter the recessed portion and caulking portion in the inner chamber of the socket holder while compressing coil spring at the same time, such that the elastic thrust applied by the coil spring is used for the plug holder and the socket holder to snap firmly, while the pin terminals of the plug main body and the socket terminal of the socket main body form electrical connection. Thereby, the purpose that a connector is applicable to two types of sockets is achieved. However, such cable connector with inner, outer threads as switch and caulking structures, which would result in failure or displacement due to reduced joining stress after long term use, and in turn, lose switching and caulking functions. Moreover, power transmission interrupt would occur easily and there would be safety problem as the connector joint is loosened. Further, the inner, outer threads are arranged in the inner chamber of the plug, such that assembly and mounting, retreat and maintenance are inconvenient for the cable connector, and the requirements of convenience and high efficiency are not met.

In view of the fact, the applicant of the invention has made efforts to study and develop a switch assembly of cable connector in order to fix various conventional shortages mentioned above.

SUMMARY OF THE INVENTION

The major objective of the present invention is the utilization of a switching unit in conjunction with a elastic element to perform rotational switching such that a plug holder may be bonded to different types of sockets, while the effects of close locking, detachment prevention, ease to assemble, ease to retreat, convenient replacement and maintenance, facile to operate and applicability to at least two different kinds of sockets are achieved as the cable connector and a socket are bonded.

To achieve the above objectives, the present invention is a switch assembly of cable connector, which includes: a plug with a plug rubber core with an inner surface and an outer edge, a housing, pin terminals, a protruding rib and a leading wire; a plug holder harnessed on outer edge of the plug rubber core movably; a switching unit joining with the plug holder movably, which is harnessed on the outer edge of the plug rubber core movably and provided between the housing and the plug holder; and an elastic element harnessed on two ends of the plug rubber core and abutted upon the housing and the switching unit, respectively.

In the preferred embodiment, the plug holder comprises a holding portion with an inner edge and an outer edge, a screw harness portion with an inner edge and a front edge provided on one end of the holding portion, multiple limiting areas provided on inner edge of the holding portion, multiple guiding portions provided on the front edge of the holding portion, multiple openings provided on the periphery of the screw harness portion, and catch pumps provided in respective openings, while the switching unit abuts against one side of the holding portion, and the holding portion and the inner edge of the screw harness portion are connected in a connection.

In the preferred embodiment, the connection for the holding portion and the inner edge of the screw harness portion has a step portion with an inner side and an outer side, while each of the limiting area is provided on the inner side of the step portion.

In the preferred embodiment, the switching unit comprises a knob with an inner edge and an outer edge which abuts against one side of the holding portion movably, and a switching ring joining with the knob.

In the preferred embodiment, the inner edge of the knob is provided with multiple adjacent extending sections, one end of each of the extending sections is provided with multiple locating pillars joining with respective limiting areas movably, and the adjacent portion for each of the extending sections has a slot respectively, and a hole is provided on each of the extending sections, while a hook buckle is provided on one side wall of each hole, in addition, the outer edge of the knob is surrounded with a recessed portion, while the bottom of the recessed portion is provided with multiple notches for each of the guiding portions to pass through each of the notch and join with the recessed portion movably.

In the preferred embodiment, the switching ring comprises a ring caught on one end of the elastic element, multiple elastic pieces provided on one end of the ring and butting each slot provided at the knob, multiple protruding portions provided on respective elastic pieces, multiple inserting portions provided on one end of the ring and penetrating into respective holes provided at the knob, and hook holes provided on respective inserting portions and butting hook buckles respectively provided in the holes, while each of the elastic pieces extends in respective openings of the screw harness portion, and one side of each of the elastic pieces abuts against one side of the catch pump.

Another preferred embodiment of the present invention includes: a plug holder harnessed on outer edge of a cable connector movably, while the plug holder comprises a holding portion, and a screw harness portion provided on one end of the holding portion; a switching unit joining the plug holder movably and harnessed at the cable connector movably, while the switching unit comprises a knob, and a switching ring joining and provided on one end surface of the knob, and the knob abuts against one side of the holding portion movably; and an elastic element harnessed on the cable connector with two ends catching at the cable connector and the switching unit, respectively.

In the above embodiment, the plug holder further comprises multiple limiting areas provided on the inner edge of the holding portion, multiple guiding portions provided on the front edge of the holding portion, multiple openings provided on the periphery of the screw harness portion, and catch pumps provided in openings respectively, while the switching unit abuts against one side of the holding portion, and the connection for the holding portion and the inner edge of the screw harness portion has a step portion, while each of the limiting areas is provided on the inner side of the step portion.

In the above embodiment, the inner edge of the knob of the switching unit is provided with multiple extending sections, one end of each of the extending sections is provided with multiple locating pillars joining respective limiting areas movably, and the adjacent portion for each of the extending sections has a slot respectively, and a hole is provided on each respective extending section, while a hook buckle is provided on one side wall of each hole respectively, in addition, the outer edge of the knob is surrounded with a recessed portion, which bottom is provided with multiple notches for each of the guiding portions to pass through each of the notches and join the recessed portion movably.

In the above embodiment, the switching ring comprises a ring caught on one end of the elastic element, multiple elastic pieces provided on one end of the ring and butting each of the slots provided at the knob, multiple protruding portions provided on respective elastic pieces, multiple inserting portions provided on one end of the ring and penetrating into respective holes provided at the knob, and hook holes provided on respective insertion portions and butting hook buckles provided in each of the holes respectively, while each of the elastic pieces extends in respective openings of the screw harness portion, and one side of each of the elastic pieces abuts against one side of the catch pump.

DETAILED DESCRIPTION OF THE PREFERRED EMBODIMENT

Figure 1:
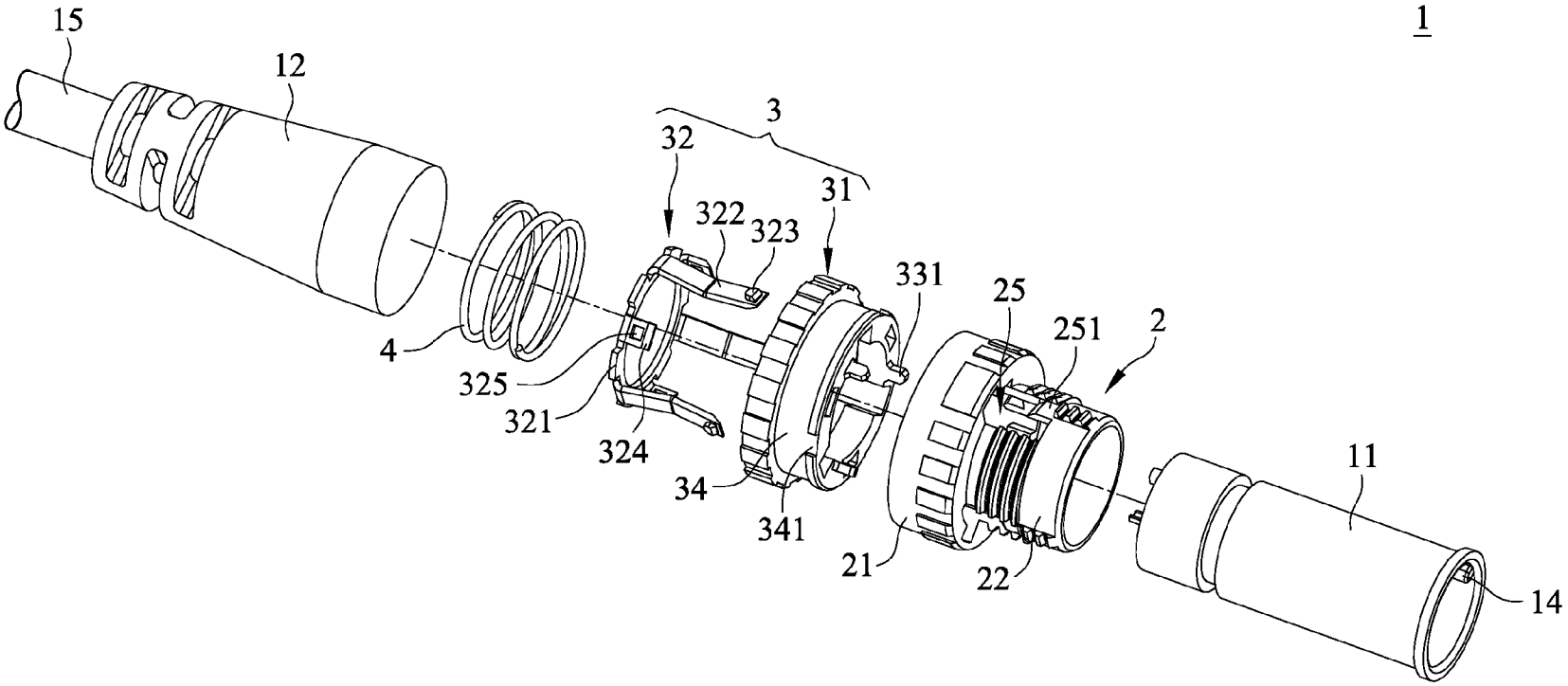
FIG. 1 is a stereo exploded schematic of the present invention.
Figure 2:
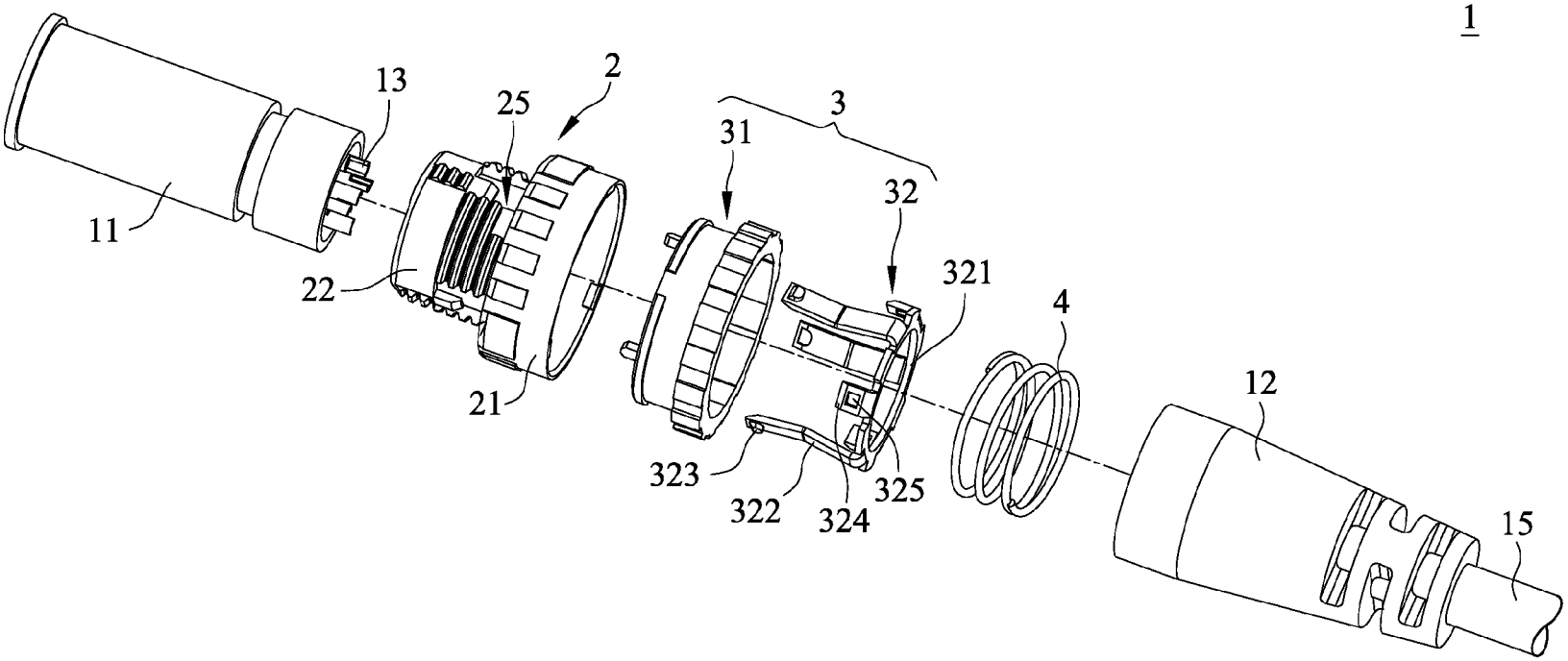
FIG. 2 is a stereo exploded schematic of the present invention from another perspective.
Figure 3:
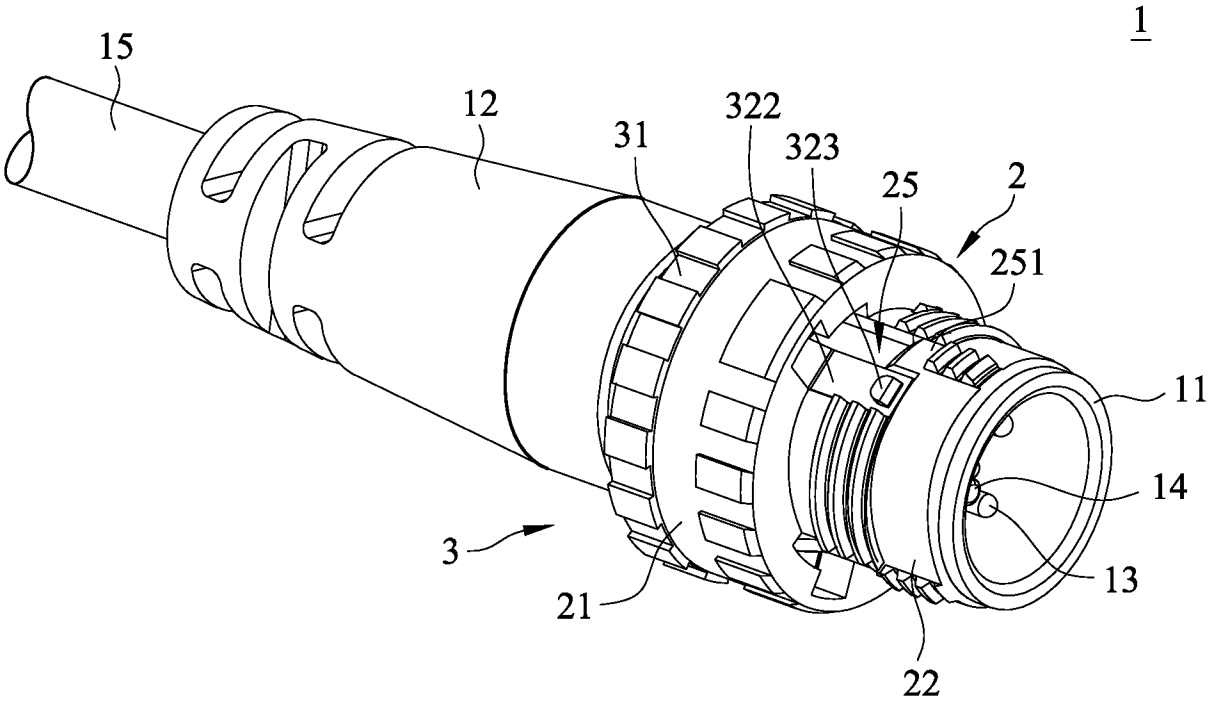
FIG. 3 is a stereo appearance schematic of the present invention.
Figure 5:
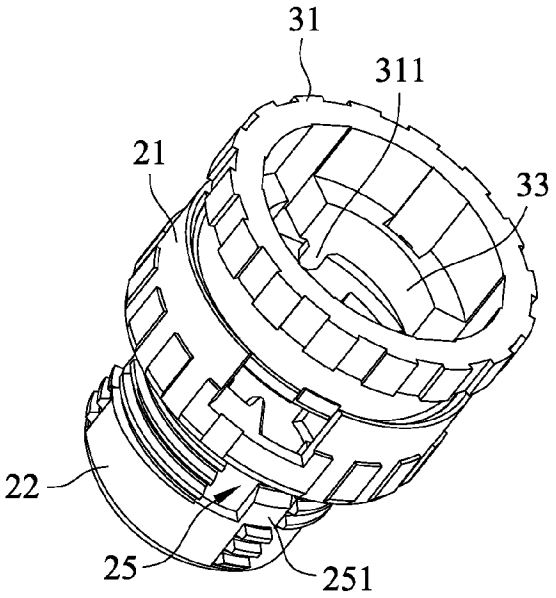
FIG. 5 is a schematic showing the present invention after the plug holder and the knob are assembled.
Figure 4:
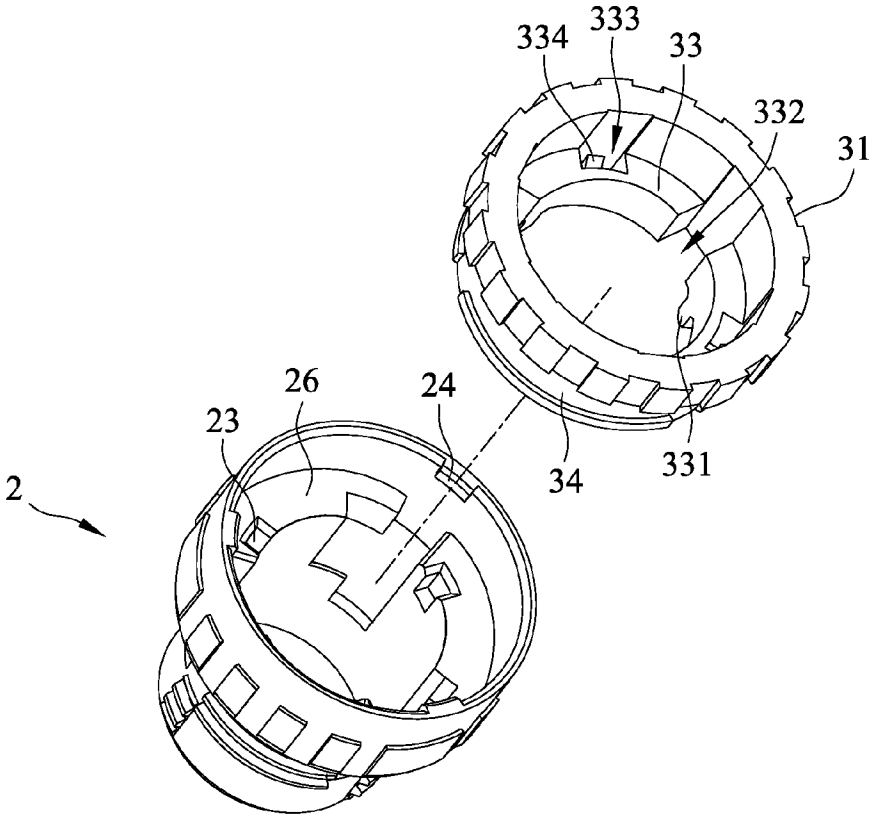
FIG. 4 is a schematic showing the assembly state of the plug holder and the knob according to the present invention.
Figure 7:
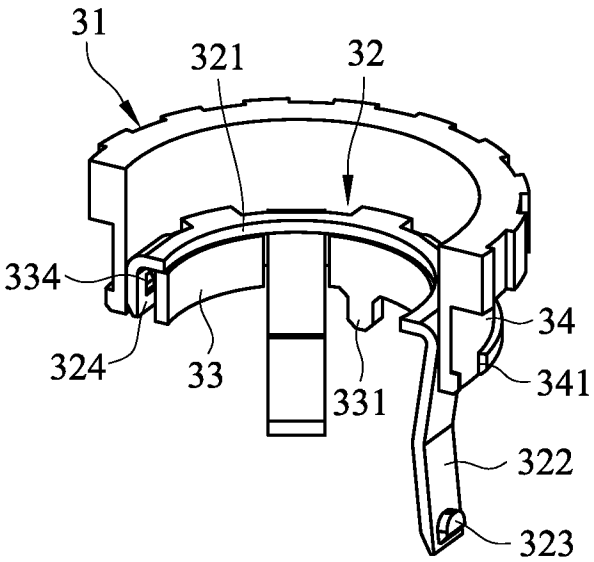
FIG. 7 is a schematic showing the cross-sectional view of the present invention after the knob and the switching ring are assembled.
Figure 6:
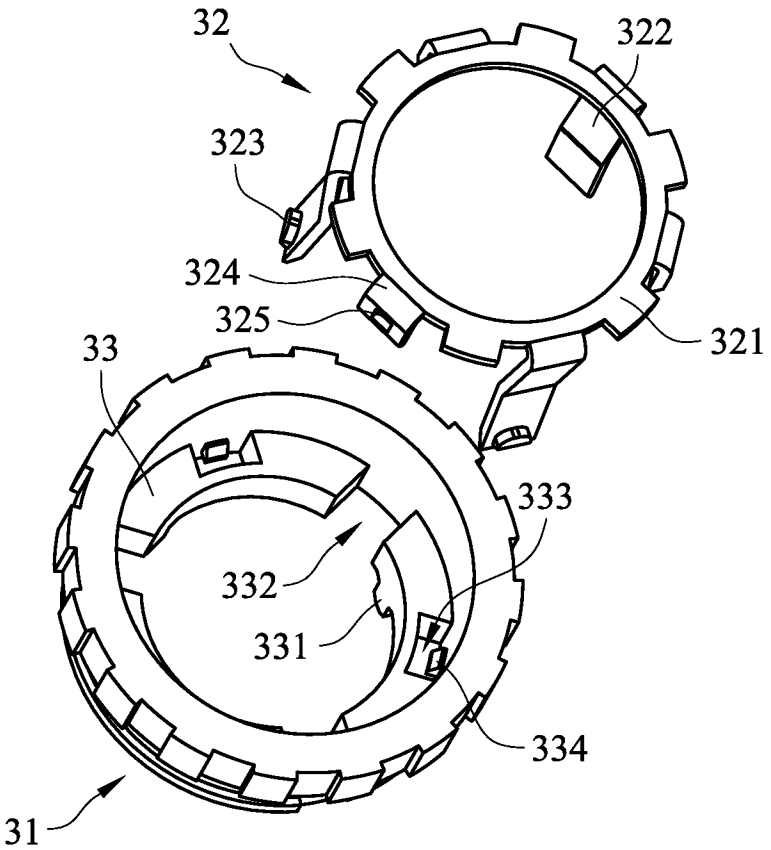
FIG. 6 is a schematic showing the assembly state of the knob and the switching ring according to the present invention.

The invention is explained in detail in conjunction with attached drawings below by the following detailed description of preferred embodiments in order for full understanding of the structures, features and effects of the invention.

Refer to FIGS. 1 to 8, which are the stereo exploded schematic of the present invention, the stereo exploded schematic of the present invention from another perspective, the stereo appearance schematic of the present invention, the schematic showing the assembly state of the plug holder and the knob of the present invention, the schematic of the present invention after the plug holder and the knob are assembled, the schematic showing the assembly state for the knob and the switching ring of the present invention, the schematic showing the cross-sectional state of the present invention after the knob and the switching ring are assembled, and the schematic of the present invention after the plug holder and the switching unit are joined, respectively. As shown in the Figures, the present invention is a switch assembly of cable connector, which is composed of a plug 1, a plug holder 2, a switching unit 3 and an elastic element 4.

The said plug 1 comprises a plug rubber core 11, a housing 12 covering the plug rubber core 11, multiple pin terminals 13 provided in the plug rubber core 11, a rib 14 provided on the inner surface of the plug rubber core 11, and a wire 15 connecting each of the pin terminals 13.

The plug holder 2 is harnessed on the outer edge of the plug rubber core 11 movably, while the plug holder 2 comprises a holding portion 21, a screw harness portion 22 provided on one end of the holding portion 21, multiple limiting areas 23 provided on the inner edge of the holding portion 21, multiple guiding portions 24 provided on the front edge of the holding portion 21, multiple openings 25 provided on the periphery of the screw harness portion 22, and multiple catch pumps 251 provided in respective openings 25, and the connection for the holding portion 21 and the inner edge of the screw harness portion 22 has a step portion 26, while each of the limiting areas 23 is provided on the inner side of the step portion 26.

The switching unit 3 joins the plug holder 2 movably, such that the switching unit 3 is harnessed on the outer edge of the plug rubber core 11 movably and is located between the housing 12 and the holding portion 21, while the switching unit 3 comprises a knob 31 abutting against one side of the holding portion 21 movably, and a switching ring 32 joining the knob 31, wherein the inner edge of the knob 31 is provided with a plurality of extending sections 33, one end of each of the extending sections 33 is provided with multiple locating pillars 331 joining the respective limiting areas 23 movably, and the adjacent portion for each of the extending sections 33 has a slot 332 respectively, and a hole 333 is provided on each of the extending sections 33, and one side wall for each of the holes 333 is provided with a hook buckle 334 thereon, in addition, the outer edge of the knob 31 is surrounded with a recessed portion 34, while the bottom of the recessed portion 34 is provided with a plurality of notches 341, such that each of the guiding portions 24 may pass through each of the notches 341 and join the recessed portion 34 movably, furthermore, the switching ring 32 comprises a ring 321, multiple elastic pieces 322 provided on one end of the ring 321 and butting each of the slots 332 provided at the knob 31, multiple protruding portions 323 provided on elastic pieces 322 respectively, multiple inserting portions 324 provided on one end of the ring 321 and penetrating respective holes 333 provided in the knob 31, and hook holes 325 provided on each inserting portions 324 and butting hook buckles 334 provided in each of the holes 333 respectively, while each of the elastic pieces 322 extends in each openings 25 of the screw harness portion 22, and one side of each of the elastic pieces 322 abuts against one side of the catch pump 251.

The elastic element 4 is harnessed on the plug rubber core 11, and two ends are abutted upon the housing 12 and the ring 321 of the switching unit 3, respectively.

Figure 8:
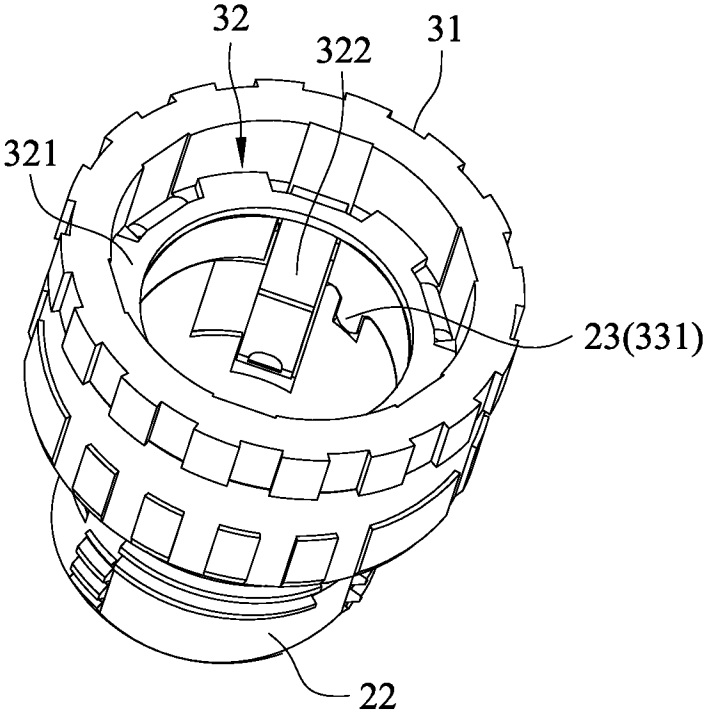
FIG. 8 is a schematic showing the present invention after the plug holder and the switching unit are joined.
Figure 9A:
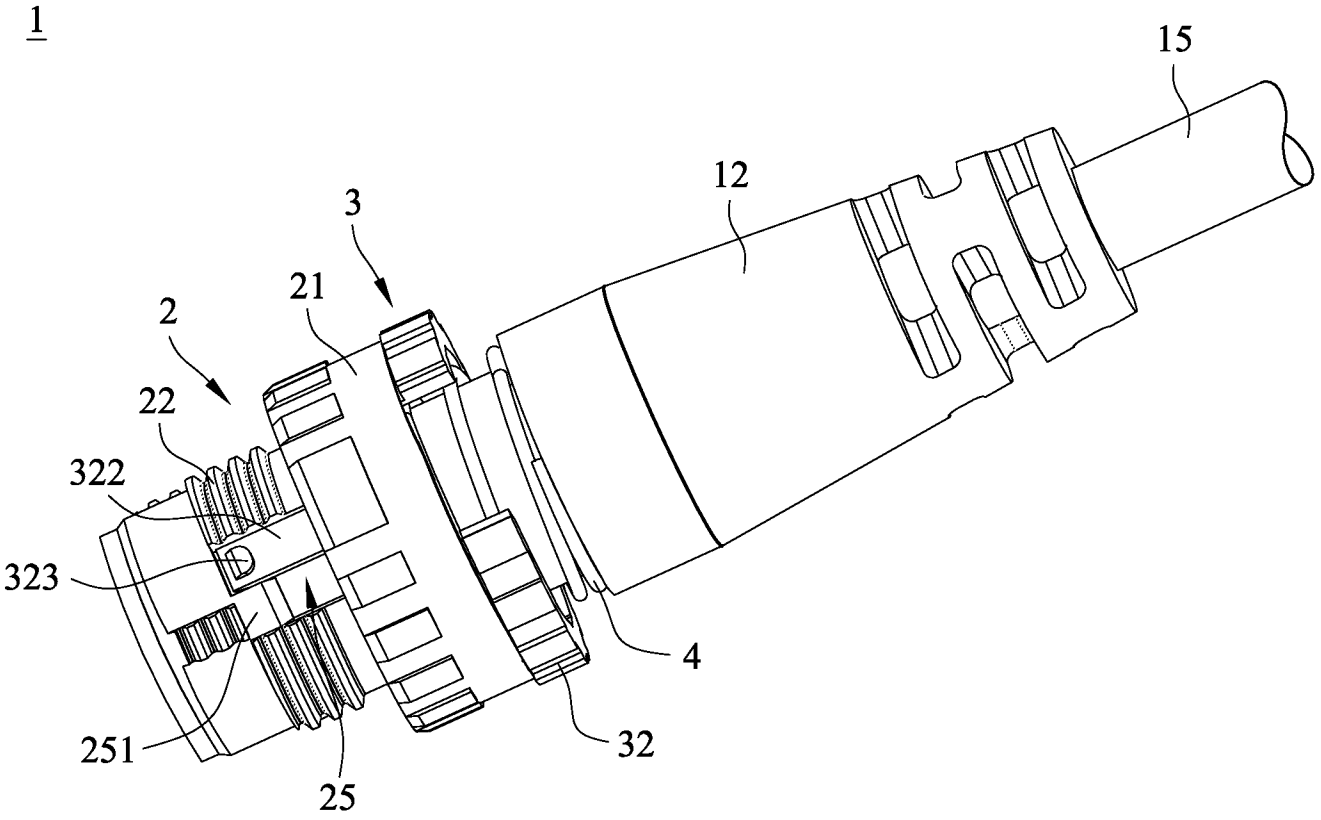
FIGS. 9A to 9D are schematic views showing the first usage profile of the present invention.
Figure 9B:
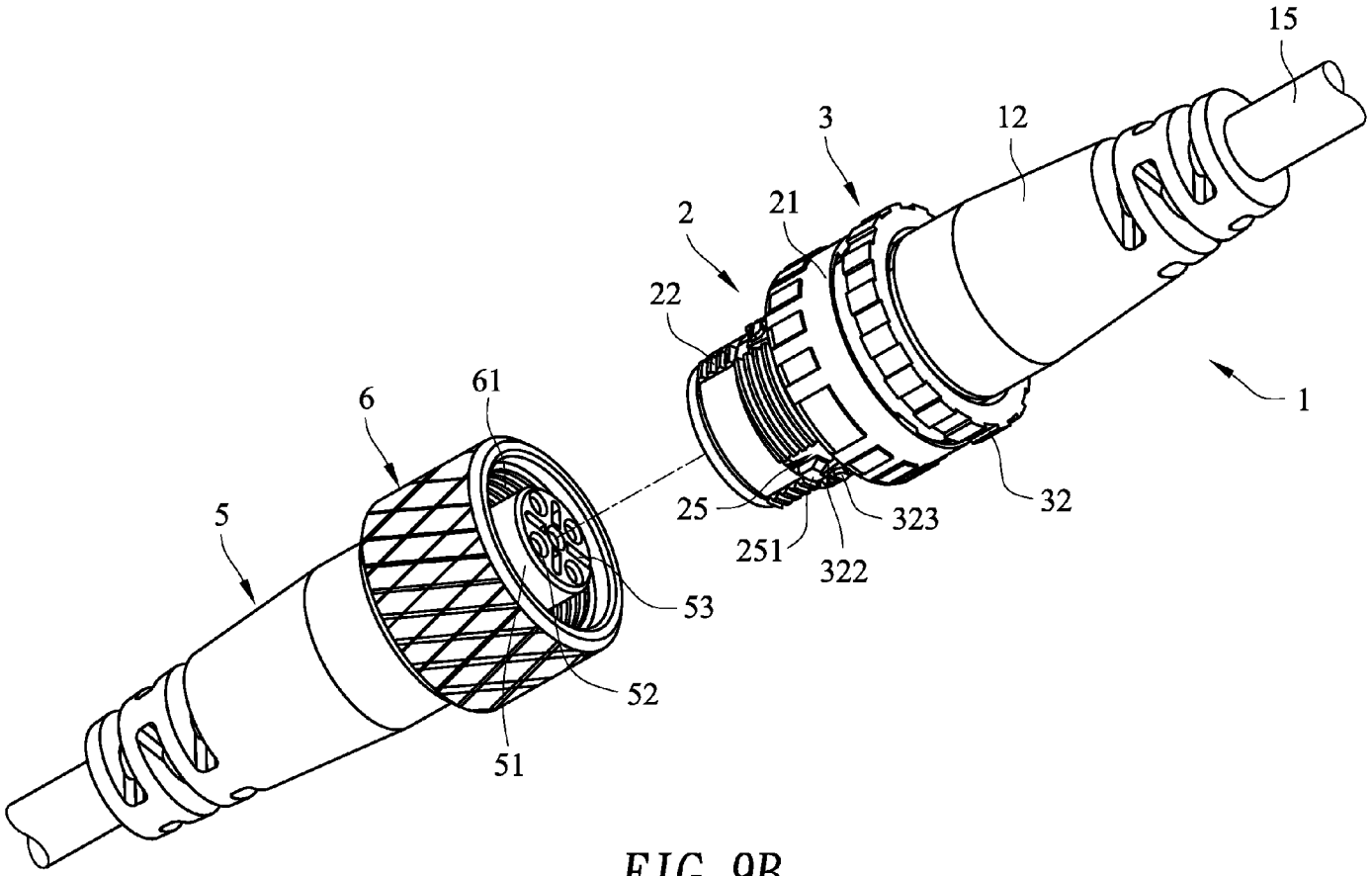
Figure 9C:
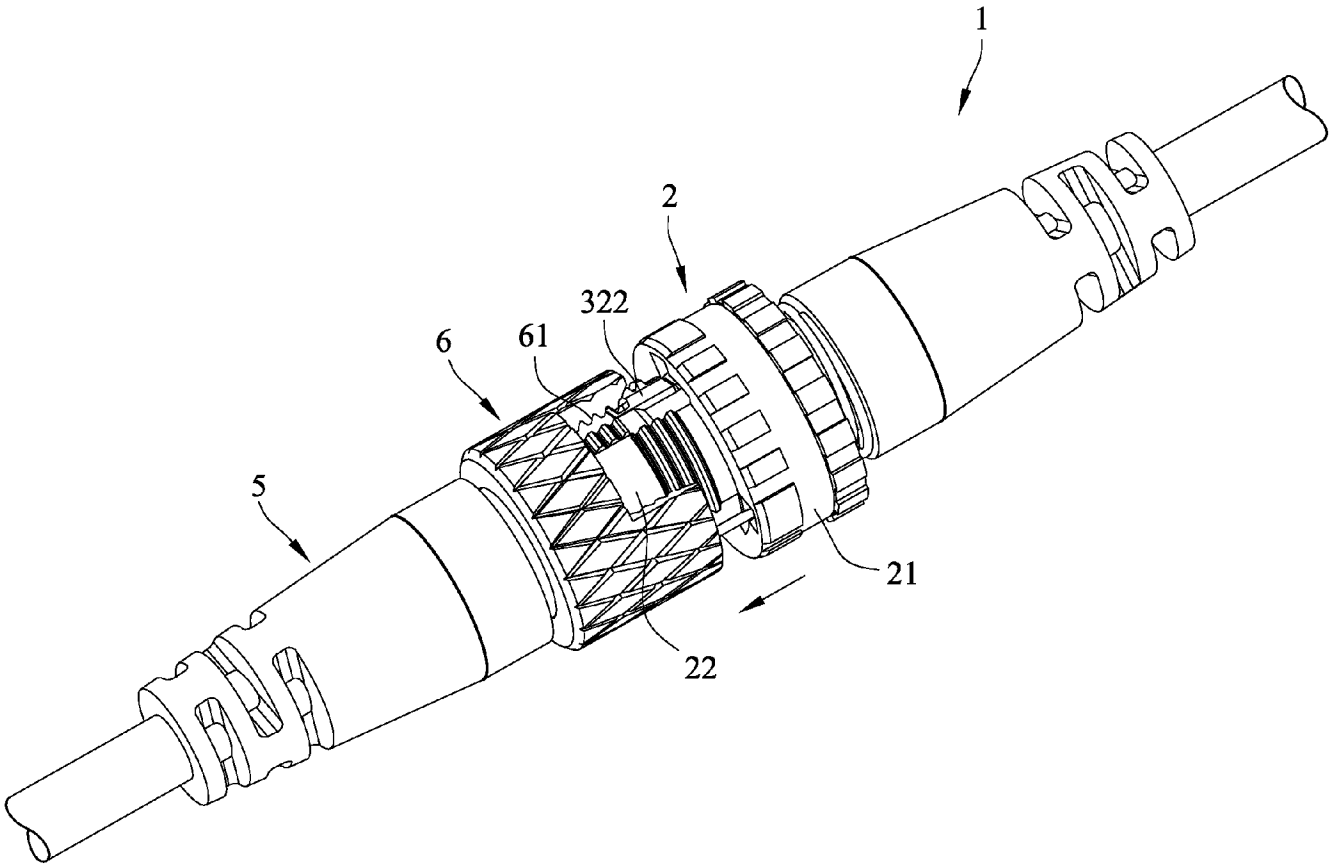
Figure 9D:
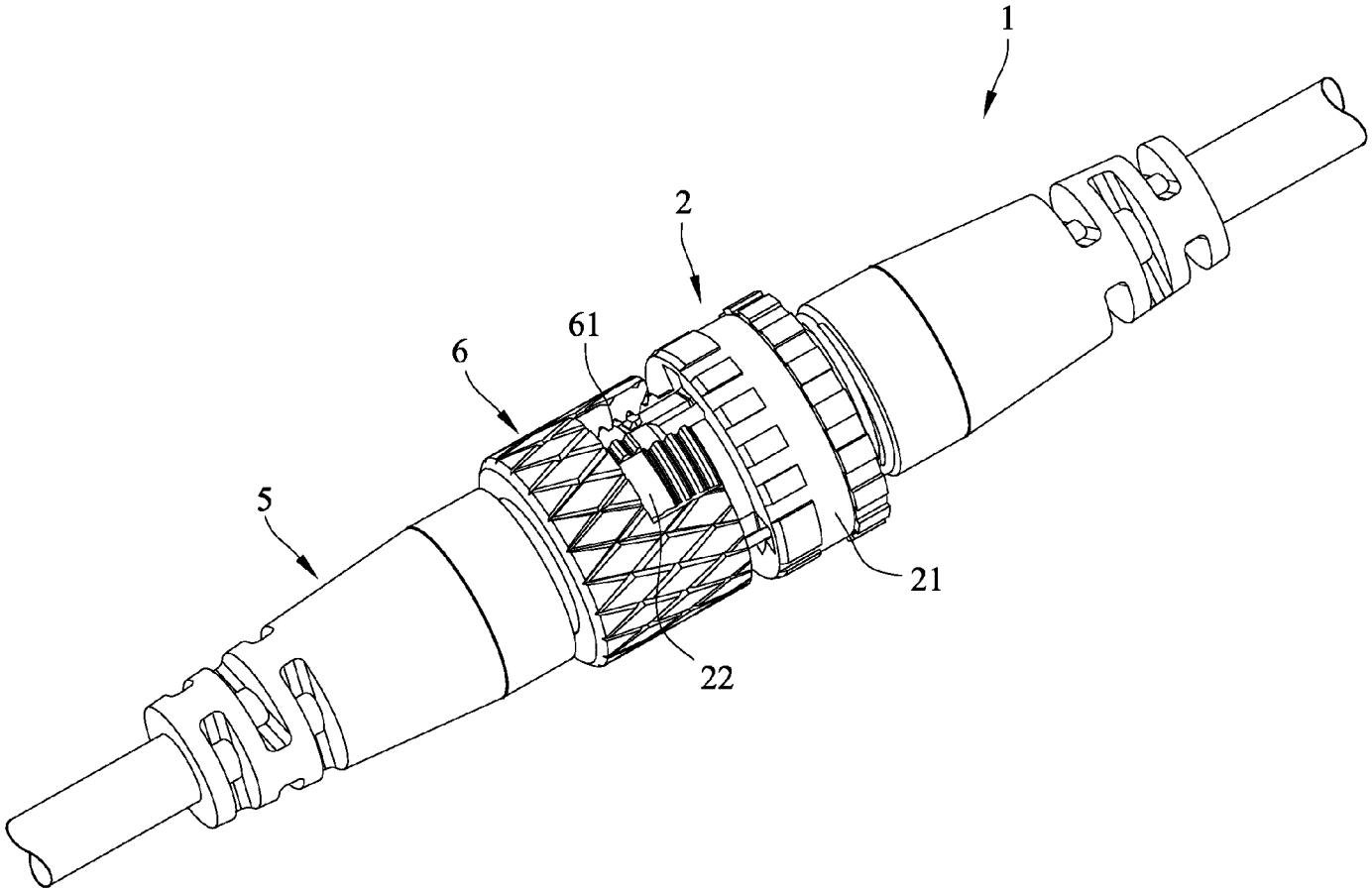

Refer to FIGS. 9A to 9D, which are schematic views showing the first usage profile of the present invention. As shown in the Figures: As the plug 1, plug holder 2 of the present invention are intended to be bonded with a general socket 5 and the socket holder 6 without caulking trough (also refer to FIGS. 1 to 8), the locating pillars 331 on one end of each of the extending sections 33 on the inner edge of the knob 31 are bonded and limited in the respective limiting areas 23 (as shown in FIG. 8), and one side of each of the elastic pieces 322 is abutted against one side (that is, the side without catch pump 251) of the catch pump 251. At the moment, the knob 31 of the switching unit 3 abuts against one side of the holding portion 21 of the plug holder 2 to be limited (as shown in FIG. 9A). As such, the plug rubber core 11 of the plug 1 may be utilized to butt the socket rubber core 51 of the socket 5 for the rib 14 of the plug 1 to align with the longitudinal slot 53 of the socket 5. After the plug rubber core 11 and the socket rubber core 51 join mutually and the rib 14 enters the longitudinal slot 53 of the socket 5 completely, each of the socket terminals 52 of the socket 5 is connected with the pin terminals 12 of the plug 1 simultaneously to form electrical connection. At the moment, the inner edge of the socket holder 6 presses the protruding portions 323 on each of the elastic pieces 322 for each of the elastic pieces 322 to be contracted inward in each of the openings 25. After that, the holding portion 21 of the plug holder 2 is rotated for the plug holder 2 to be spun into the socket holder 6, in order for the screw harness portion 22 of the plug holder 2 to be screwed with the inner thread 61 of the socket holder 6 mutually (as shown in FIGS. 9B to 9C).

Figure 10B:
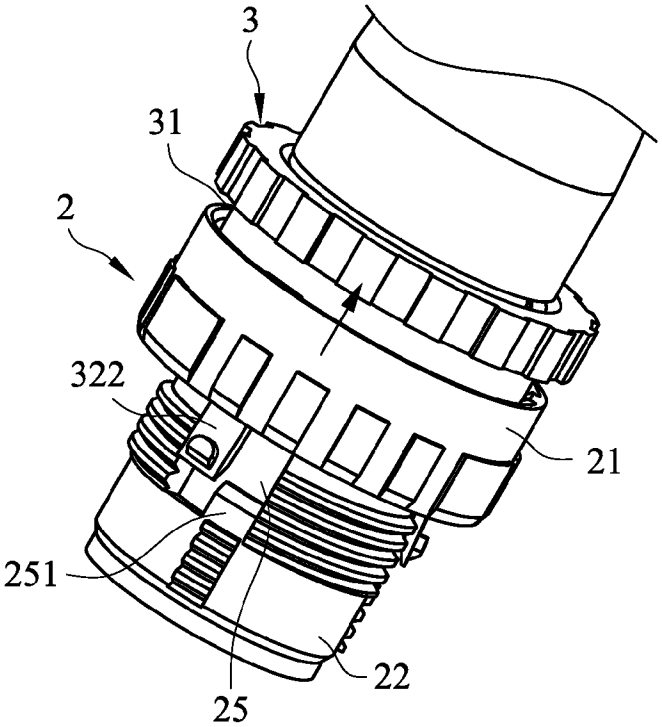
FIGS. 10A to 10D are schematic views showing the switching state for the switching unit of the present invention.
Figure 10A:
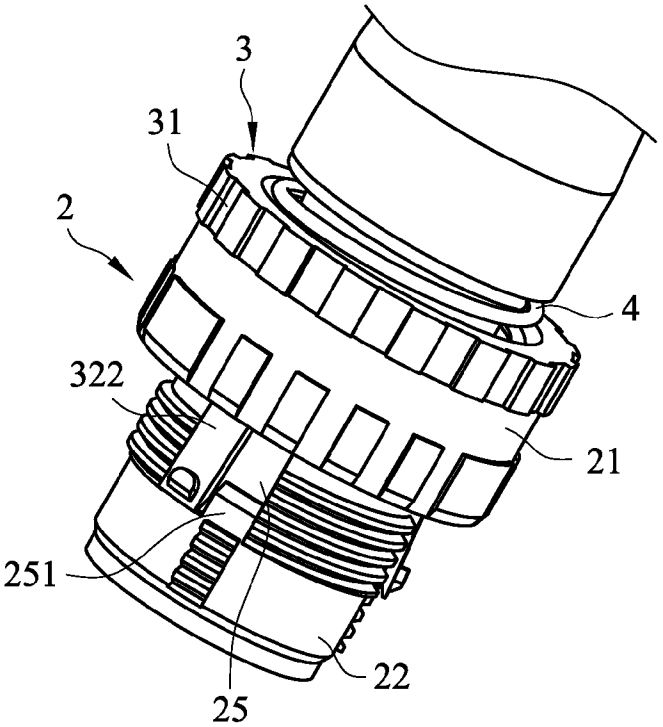
Figure 10D:
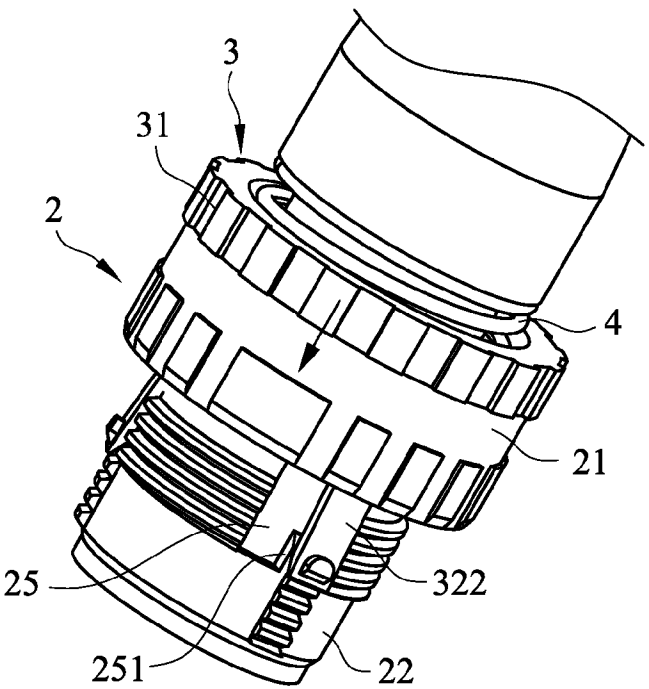
Figure 10C:
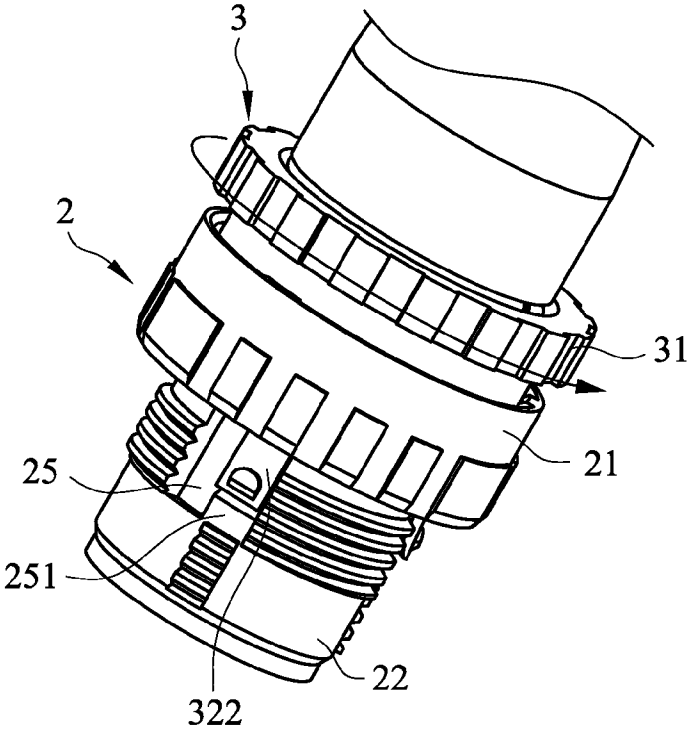
Figure 11:
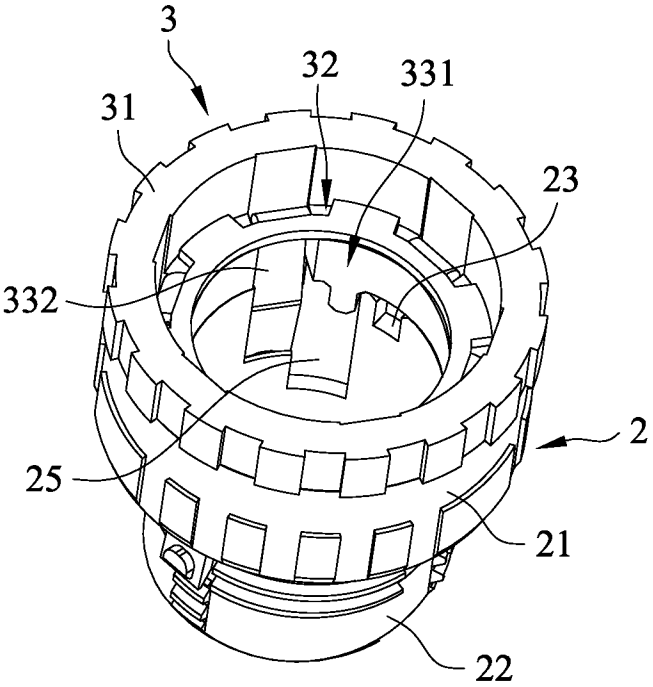
FIG. 11 is a schematic showing the present invention after the switching unit is switched.
Figure 12A:
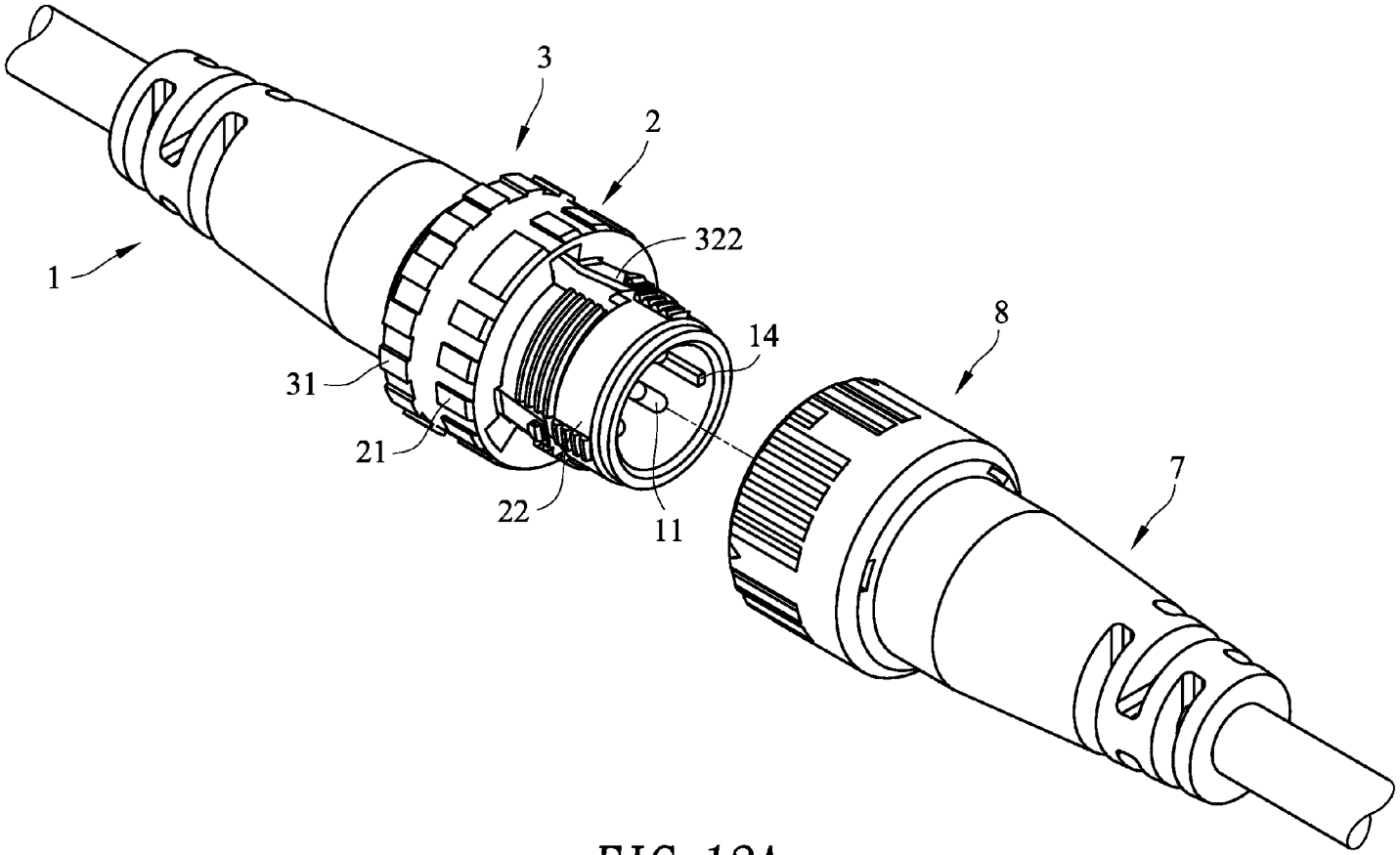
FIGS. 12A to 12F are schematic views showing the second usage profile of the present invention.
Figure 12B:
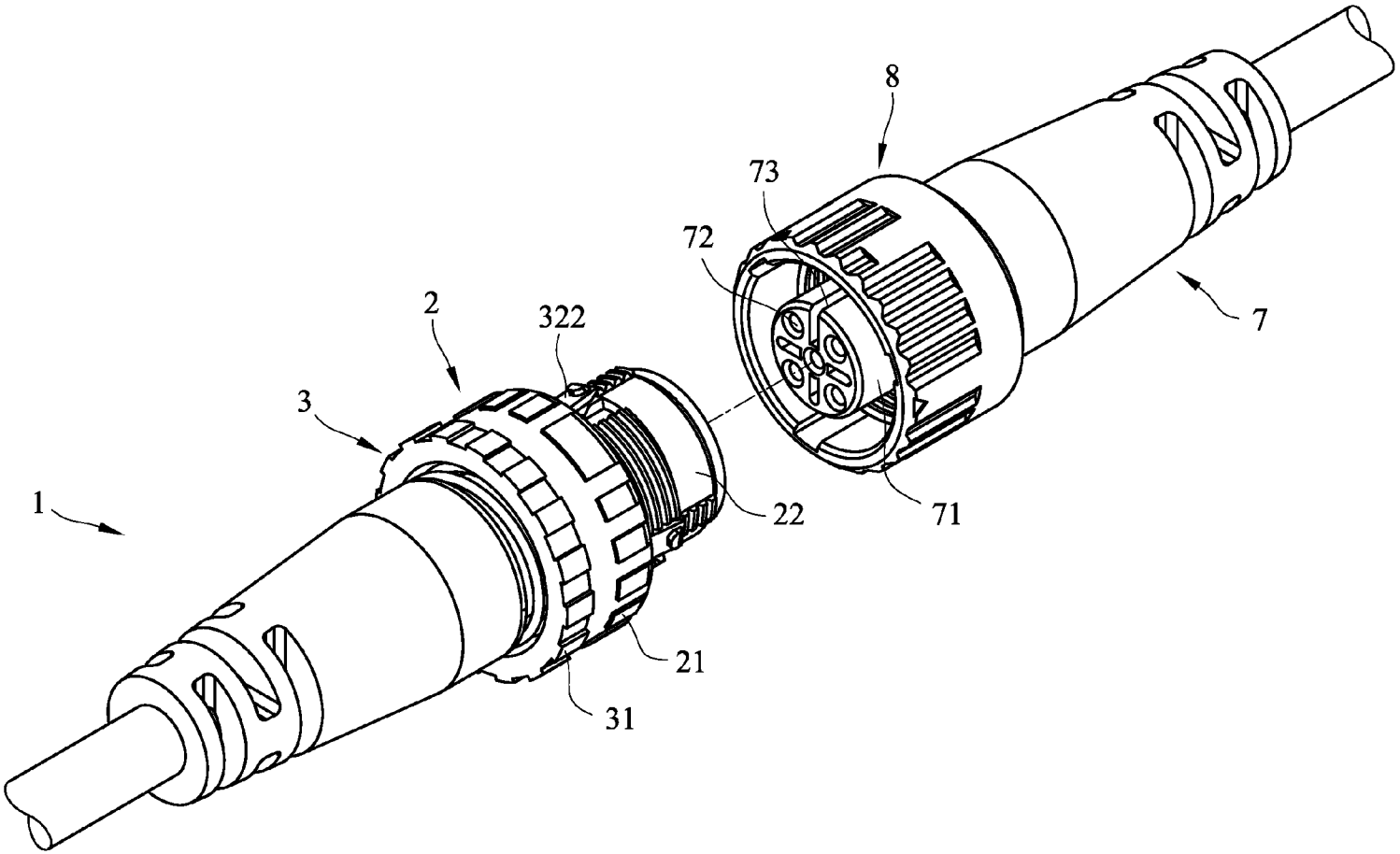
Figure 12C:
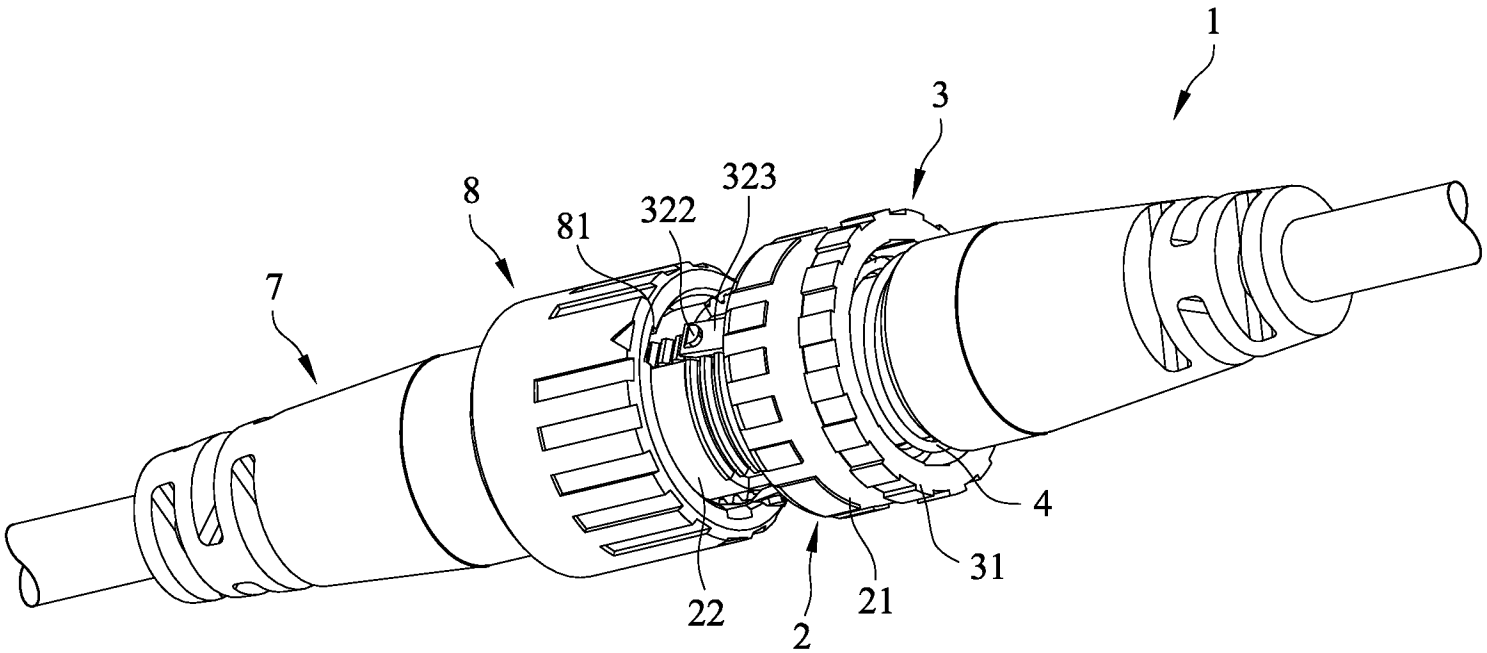
Figure 12D:
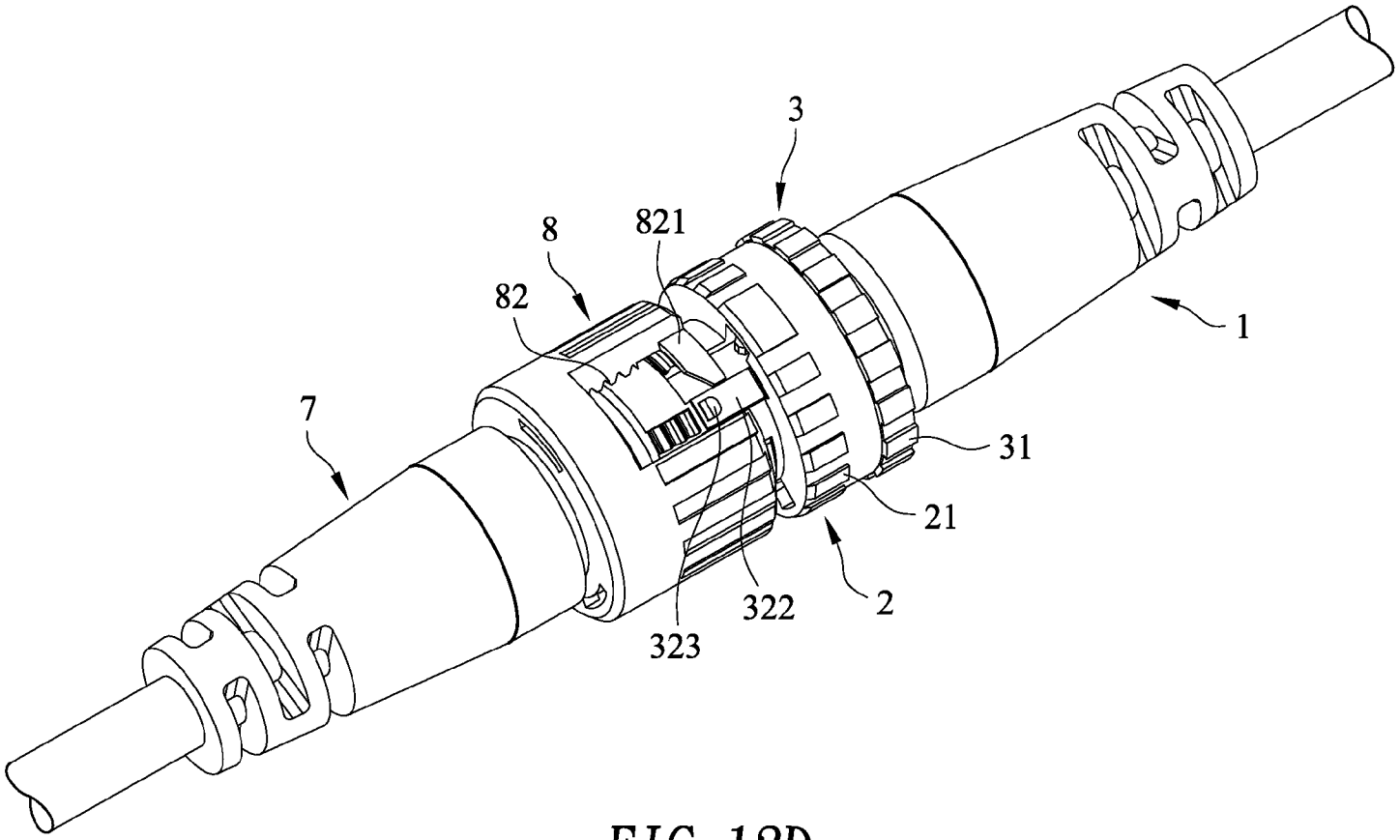
Figure 12E:
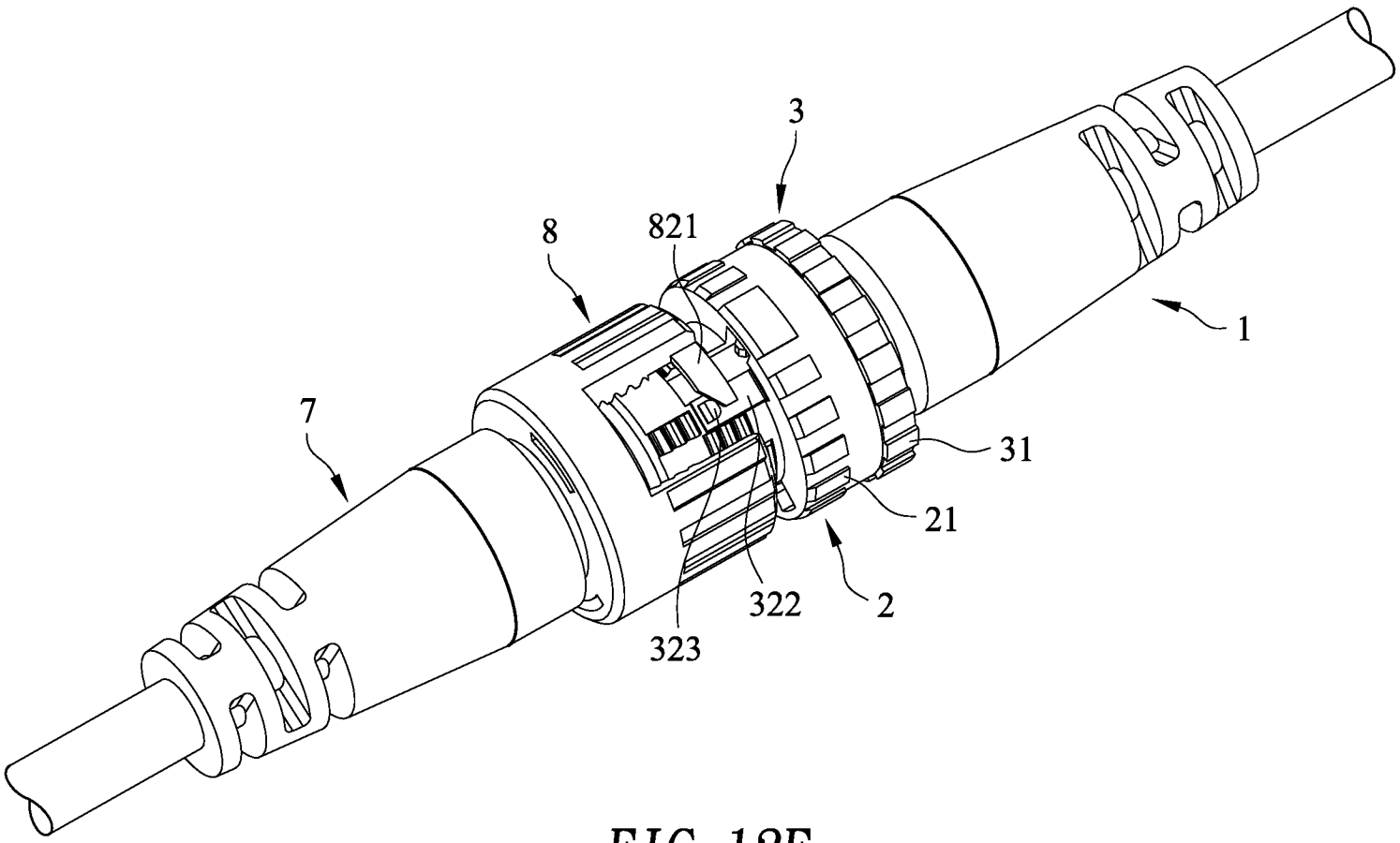
Figure 12F:
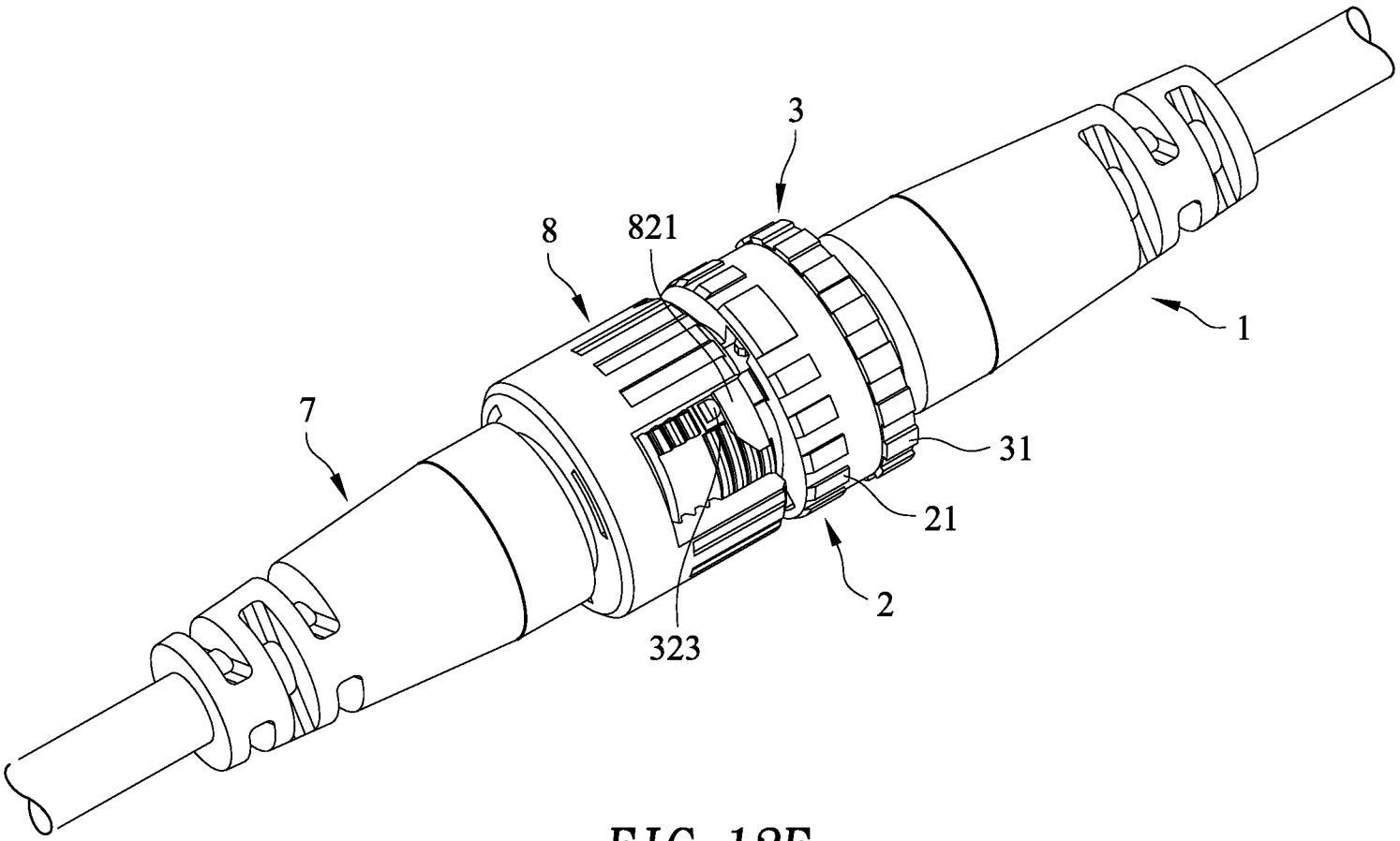

Refer to FIGS. 10A to 10D, FIG. 11, and FIGS. 12A to 12F, which are schematics of the present invention showing the switching state of the switching unit, the schematic showing the present invention after the switching unit is switched, and the schematics showing the second usage profile of the present invention. As shown in the Figures: As the plug 1, plug holder 2 of the present invention are intended to be connected with the socket 7 and the socket holder 8 with caulking trough (also refer to FIGS. 1 to 8), the knob 31 is held and pulled upward, such that the knob 31 drives the switching ring 32 to move upward simultaneously, for the locating pillars 331 on one end of each of the extending sections 33 on the inner edge of the knob 31 to be separated from respective limiting areas 23, and for one side of each of the elastic pieces 322 to be separated from one side of the catch pump 251 (as shown in FIGS. 10A and 10B), and for the ring 321 of the switching ring 32 to compress the elastic element 4. After that, the switching ring 32 is rotated for each of the elastic pieces 322 thereon to be displaced to the upper portion on the catch pump 251 of the openings 25 (as shown in FIG. 10C). Finally, the knob 31 moves toward the plug holder 2 with the catching of the elastic element 4 for the knob 31 to abut against the holding portion 21, and for each of the elastic pieces 322 to be displaced to the upper portion on the catch pump 251. In turn, each of the elastic pieces 322 presents an upward supporting in each of the openings 25 of the plug holder 2, simultaneously, one side of each of the locating pillars 331 abuts against one side of the respective openings 25 facing away from the catch pump 251 to form positioning state (as shown in FIGS. 10D and 11). After the aforementioned operations are completed, the plug rubber core 11 of the plug 1 may be utilized to butt the socket rubber core 71 of the socket 7 (as shown in FIGS. 12A to 12F), and the rib 14 of the plug 1 may align with the longitudinal slot 73 of the socket 7 simultaneously. After the plug rubber core 11 and the socket rubber core 71 join mutually and the rib 14 enters the longitudinal slot 73 of the socket 7 completely, each socket terminal 72 of the socket 7 is connected with the pin terminals 12 of the plug 1 simultaneously and forms electrical connection, such that the plug holder 2 enters into the socket holder 8, and each of the elastic pieces 322 enters the socket holder 8 along the recessed portion 81. After that, the socket holder 8 with caulking trough 82 is rotated for each of the elastic pieces 322 to move along the caulking trough 82 for each of the elastic pieces 322 to snap on the caulking surface 821. At the moment, the protruding portions 323 on each of the elastic pieces 322 abut the caulking surface 821 on the caulking trough 82 to increase the firmness. The engaging caulk of the plug holder 2 and the socket holder 8 is attributed for the cable connector to achieve the firm matching effect. On the other hand, as each of the elastic pieces 322 is to be operated to retreat from the caulking surface 821, the socket holder 8 of the caulking trough 82 is simply rotated inversely. After each of the elastic pieces 322 moves to abut against the caulking trough 82, the plug holder 2 is retreated by the outward force along the recessed portion 81, such that the retreating operation for the plug holder 2 and the socket holder 8 are completed to achieve the effect of detachment prevention of cable connector and easy assembly, retreating.

In summary, from the contents disclosed above, the invention does accomplish the expected purposes of the creation. With the switch assembly of the cable connector, the switching unit may be utilized to perform rotational switching in conjunction with the elastic element for the plug holder to be connected with different types of sockets. Furthermore, the effects of close locking, detachment prevention, ease to assemble, ease to retreat, convenient replacement and maintenance, facile to operate and applicability to at least two different types of sockets are achieved as the cable connector and a socket are bonded.

What is claimed is:

1. A switch assembly of cable connector, comprising:

a plug, which comprises a plug rubber core with an inner surface and an outer edge, a housing covering said plug rubber core, a plurality of pin terminals provided in said plug rubber core, a rib provided on the inner surface of said plug rubber core, and a wire connecting each of said pin terminals;

a plug holder harnessed on the outer edge of the plug rubber core movably;

a switching unit joining with said plug holder movably, and harnessed on the outer edge of said plug rubber core movably, and provided between said housing and said plug holder; and an elastic element harnessed on said plug rubber core with two ends abutted upon said housing and said switching unit, respectively.

2. The switch assembly of cable connector as claim 1, wherein said plug holder comprises a holding portion with an inner edge and an outer edge, a screw harness portion with an inner edge and a front edge provided on one end of said holding portion, multiple limiting areas provided on the inner edge of said holding portion, multiple guiding portions provided on the front edge of said holding portion, multiple openings provided on the periphery of said screw harness portion, and multiple catch pumps provided in each of said openings, respectively, while said switching unit abuts against one side of said holding portion, and the holding portion and the inner edge of the screw harness portion are connected in a connection.

3. The switch assembly of cable connector as claim 2, wherein, the connection between said holding portion and the inner edge of said screw harness portion has a step portion with an inner side and an outer side, while each of said limiting area is provided on the inner side of said step portion.

4. The switch assembly of cable connector as claim 1, wherein, said switching unit comprises a knob with an inner edge and an outer edge which is abutting against one side of said holding portion movably, and a switching ring joining with said knob.

5. The switch assembly of cable connector as claim 4, wherein, the inner edge of said knob is provided with multiple adjacent extending sections, one end of each of said extending sections is provided with multiple locating pillars joining with said limiting areas movably, respectively, and the adjacent portion for each of said extending sections is provided with a slot respectively, and each of said extending sections is provided with a hole thereon respectively, while one side wall of each of said holes is provided with a hook buckle thereon respectively, furthermore, the outer edge of said knob is surrounded with a recessed portion, while the bottom of said recessed portion is provided with multiple notches, such that each of said guiding portions can pass through each of said notches and join with said recessed portion movably.

6. The switch assembly of cable connector as claim 4, wherein, said switching ring comprises a ring catching one end of said elastic element, multiple elastic pieces provided on one end of said ring and butting each of said slots provided at said knob, multiple protruding portions provided on said elastic pieces, respectively, multiple inserting portions provided on one end of said ring and penetrating into each of said holes provided at said knob, and hook holes provided on each of said inserting portions and butting hook buckles provided in said holes respectively, while each elastic pieces extends in each of said openings of said screw harness portion, and one side of each of said elastic pieces abuts against one side of a catch pump.

* * * * *